US007806053B1

(12) United States Patent
King et al.

(10) Patent No.: US 7,806,053 B1
(45) Date of Patent: Oct. 5, 2010

(54) METHOD AND APPARATUS FOR CHANGING THE SPIN OF A PROJECTILE IN FLIGHT

(75) Inventors: Hartley Hughes King, Santa Barbara, CA (US); Thomas Louis Menna, Santa Barbara, CA (US); Lawrence Steven Romero, Santa Ynez, CA (US)

(73) Assignee: AT&T Intellectual Property II, L.P., Reno, NV (US)

( * ) Notice: Subject to any disclaimer, the term of this patent is extended or adjusted under 35 U.S.C. 154(b) by 1092 days.

(21) Appl. No.: 11/501,659

(22) Filed: Aug. 9, 2006

Related U.S. Application Data

(60) Provisional application No. 60/797,205, filed on May 3, 2006.

(51) Int. Cl.
*F42B 12/58* (2006.01)

(52) U.S. Cl. ..... 102/517; 102/393; 102/489

(58) Field of Classification Search ..... 102/438, 102/439, 489, 517, 518, 519, 521, 393
See application file for complete search history.

(56) References Cited

U.S. PATENT DOCUMENTS 4,090,446 A 5/1978 Tomasetti
4,676,167 A * 6/1987 Huber et al. ..... 102/393
4,856,432 A * 8/1989 Synofzik ..... 102/489
4,878,432 A * 11/1989 Mikhail ..... 102/309
5,398,615 A * 3/1995 Johnsson et al. ..... 102/489
5,526,752 A * 6/1996 Dahl et al. ..... 102/517
5,834,684 A * 11/1998 Taylor ..... 102/517
5,988,071 A * 11/1999 Taylor ..... 102/473
6,021,716 A * 2/2000 Taylor ..... 102/517
6,481,666 B2 * 11/2002 Frucht ..... 244/3.15
6,510,797 B1 1/2003 Fong
6,817,568 B2 * 11/2004 Spate et al. ..... 244/3.15
7,448,324 B1 * 11/2008 King et al. ..... 102/517

* cited by examiner

*Primary Examiner*—James S Bergin
(74) *Attorney, Agent, or Firm*—Ronald D. Slusky

(57) ABSTRACT

At least some of the segments of a segmented rod projectile are provided with a mechanism that causes them to divert away from the projectile's original line of flight after the segments are separated during flight to the target. That mechanism is illustratively a notched flare. The segments illustratively divert in a predetermined dispersion pattern. In order to ensure that each segment flies in the desired direction after separation, the disclosed projectile includes a mechanism that, just prior to segment separation, arrests spin of the projectile. Thus the segments are essentially non-spinning after separation and thus the desired diversion will not be counteracted by post-separation spin of the segments.

10 Claims, 9 Drawing Sheets

10

METHOD AND APPARATUS FOR CHANGING THE SPIN OF A PROJECTILE IN FLIGHT

CROSS-REFERENCE TO RELATED APPLICATION

This application claims the benefit of U.S. provisional application 60/797,205 filed May 3, 2006.

BACKGROUND OF THE INVENTION

The present invention relates to projectiles that spin in flight.

It is usually desirable to impart a spin to a projectile, such as a munitions projectile, as this helps keep the projectile on the intended trajectory. There may be applications, however, where it is desired to change the rate of spin in mid-flight. In particular, it may be desired to reduce or (to the extent practical) eliminate the spin.

SUMMARY OF THE INVENTION

The present invention is directed to a method and apparatus for changing the rate of spin of a projectile in flight. In accordance with the invention, a segment of the projectile is detached from the projectile during flight, with a spin being imparted to the detached segment relative to the rest of the projectile, herein referred to as the "remaining projectile." Due to the law of the conservation of angular momentum, the rate of spin of the remaining projectile is changed (increased or decreased) by an amount that is substantially equal in magnitude to, but opposite in sign from, the change in angular momentum of the detached segment.

In a particular embodiment, the spin imparted to the detached segment relative to the remaining projectile is in the same angular direction as the spin of the remaining projectile. That is, the detached segment is made to spin faster than it was before (relative to an inertial reference frame) and in the same angular direction. This causes a reduction in the rate of spin of the remaining projectile. In particular embodiments, the amount of spin imparted to the detached segment relative to the remaining projectile may be such as to reduce the remaining projectile's rate of spin to zero or close to zero.

As discussed more fully hereinbelow, a particular application for the invention is the segmented rod projectile, or penetrator, disclosed in the co-pending application filed of even date herewith, Ser. No. 11/501,540, now U.S. Pat. No. 7,448,325 issued Nov. 11, 2008 entitled "Segmented Rod Projectile," assigned to the same assignee, and hereby incorporated by reference as though fully set forth herein. As the name implies, such a projectile is in the form of a rod that is made up of interconnected segments. The projectile is launched toward a target from a medium-to-large caliber gun, a missile, or even just gravity-dropped from high altitude, for example. At a particular point in the projectile's flight toward the target, the segments are separated from one another by an appropriate separation mechanism. The target is thus impacted by the separate but collinear segments, rather than being impacted by a unitary projectile. This is advantageous because of the segment aspect ratio effect that results in added penetration efficiency of the multiple impacting segments. This will typically produce greater penetration than would, a unitary projectile of the same total mass and length. For this type of projectile to be effective the impact velocity, segment spacing and segment alignment are important design factors. The segmented rod projectile disclosed in the above-cited patent application is designed in such a way that at least some of the segments are made to divert away from the original line of flight after being separated from one another. The target is thus impacted over a wider area than with segmented rod projectiles whose segments continue to fly substantially collinearly after separation. This, advantageously, enables the weapon to more effectively damage and/or destroy particular types of targets over a wider range of velocities without the limitations of segment alignment and spacing mentioned previously. Diversion of the segments is illustratively effectuated through aerodynamic design of the segments. The aerodynamic design of the segments illustratively features a notched flare that causes the segment diversion.

The projectile disclosed in the above-cited patent application implements the principles of the present invention in order to ensure that each segment flies in the desired direction after separation. In particular, it is desirable to despin the projectile just prior to segment separation so that the segments are essentially non-spinning after separation. Otherwise the desired diversion would be counteracted by post-separation spin of the segments.

In a particular embodiment of the invention, the jettisoned segment of the projectile is its tail segment. The tail segment includes a piston having an outer surface that mates with the inner surface of a mating chamber in the aft end of the remainder of the projectile. The mating chamber, more particularly, may be within the second-to-last segment of the above-mentioned segmented rod projectile. At least one—and illustratively both—of the two mating surfaces are rifled. At the point in time that it is desired to effect the despinning, the tail segment is forced off the projectile. The fact that the two surfaces are interconnected at a rifled interface imparts the aforementioned spin to the tail segment relative to the remainder of the projectile as it is detached from the rest of the projectile.

In the disclosed embodiment, the tail segment is forced off the projectile by gas pressure created in the mating chamber by the ignition of a propellant in the mating chamber. Those gases push against the tail segment's piston with enough force to break connectors—such as shear threads or shear pins—that connect tail segment to the rest of the projectile. The propellant is illustratively ignited by igniting an igniter in the tail segment under electronic control by circuitry within the tail segment. This causes hot gases to propagate through a gas passage extending through the piston into the mating chamber. It is those hot gases that ignite the propellant in the mating chamber.

DETAILED DESCRIPTION OF AN ILLUSTRATIVE EMBODIMENT

Figure 1:
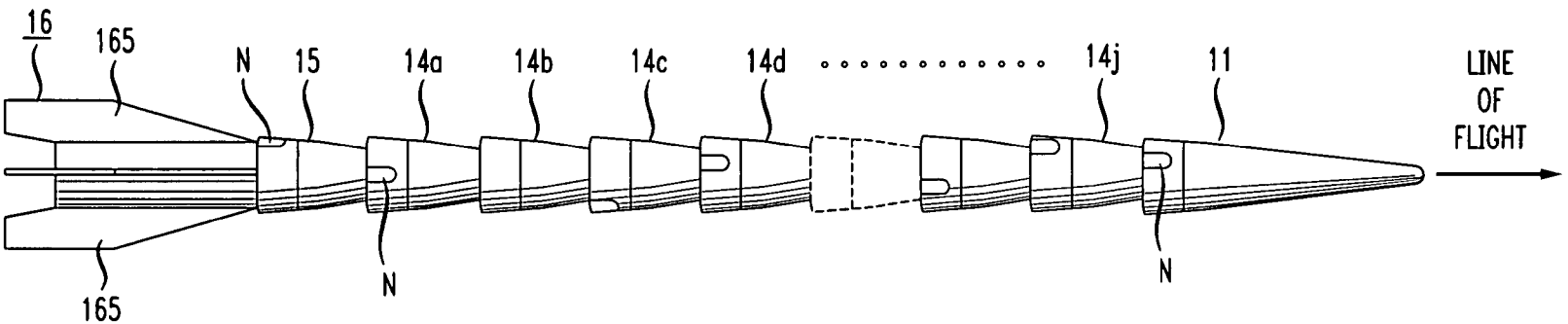
FIG. 1 shows a segmented projectile having a despinning mechanism embodying the principles of the present invention.

FIG. 1 shows a segmented projectile or penetrator 10 (hereinafter "projectile") that implements a despinning mechanism pursuant to the principles of the present invention.

Projectile 10 includes a lead segment 11, a number of intermediate segments 14*a*-14*j* and 15, and a tail segment 16. Segment 15 is also referred to herein as the "second-to-last" segment. The main body of each of the segments is illustratively made from a tungsten alloy to maximize penetration but could effectively be made of other materials depending on the application and launcher characteristics and constraints. Projectile 10 can be of various sizes, from a fraction of a foot to tens of feet, depending on the application.

Segments 14*a*-14*j* and 15 are of a generally conical shape. The body of tail segment 16 is of a generally cylindrical shape and has a number of fins 165 attached thereto. Illustratively, there are four fins 165, but six fins is also typical in projectiles of this type and projectile 10 could certainly have six fins or any other desired number. Overall, projectile 10 has a high ballistic coefficient (mass-to-drag-area ratio) in order to get it to its target with a high impact velocity.

Each of the segments except for tail segment 16 terminates in a notched flare having a notch N described more fully below.

Projectile 10 is designed to be launched from a gun or other launch platform in the low-drag configuration shown, i.e., as a mono rod or unsegmented single continuous rod. Indeed, if desired, it could be allowed to fly all the way to its target in that form. However, projectile 10 is designed to break into multiple individual segments just before impact, with the segments then continuing on to the target. Projectile 10 is illustratively a kinetic energy projectile, meaning that the target is damaged and/or destroyed simply by virtue of the kinetic impact energy of the segments, rather than by chemical energy from any explosive charged warhead.

The separation of the segments—referred to herein as "segmentation"—is brought about in any desired way using, for example, compressed springs, explosive charges or aerodynamically with the deployment of petals on the segments. The manner in which the segmentation is brought about is not germane to the invention and thus need not be described in further detail herein.

In accordance with the invention taught in the above-cited co-pending patent application, the projectile is designed in such a way that at least some of the segments are made to divert away from the original line of flight of the projectile after being detached, or separated, from the rest of the projectile. The target is thus impacted over a wider area than with prior art segmented rod projectiles whose segments continue to fly substantially collinearly after separation. This, advantageously, enables the projectile to more effectively damage and/or destroy particular types of targets.

Figure 2:
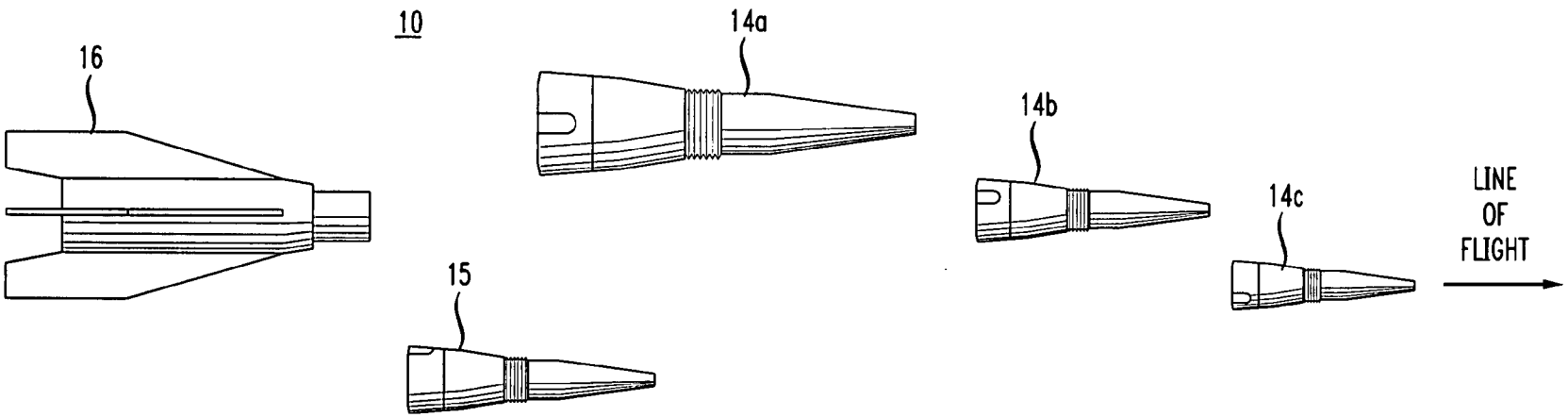
FIG. 2 shows the rear five segments of the projectile of FIG. 1 in flight at a point in time after segmentation.
Figure 3:
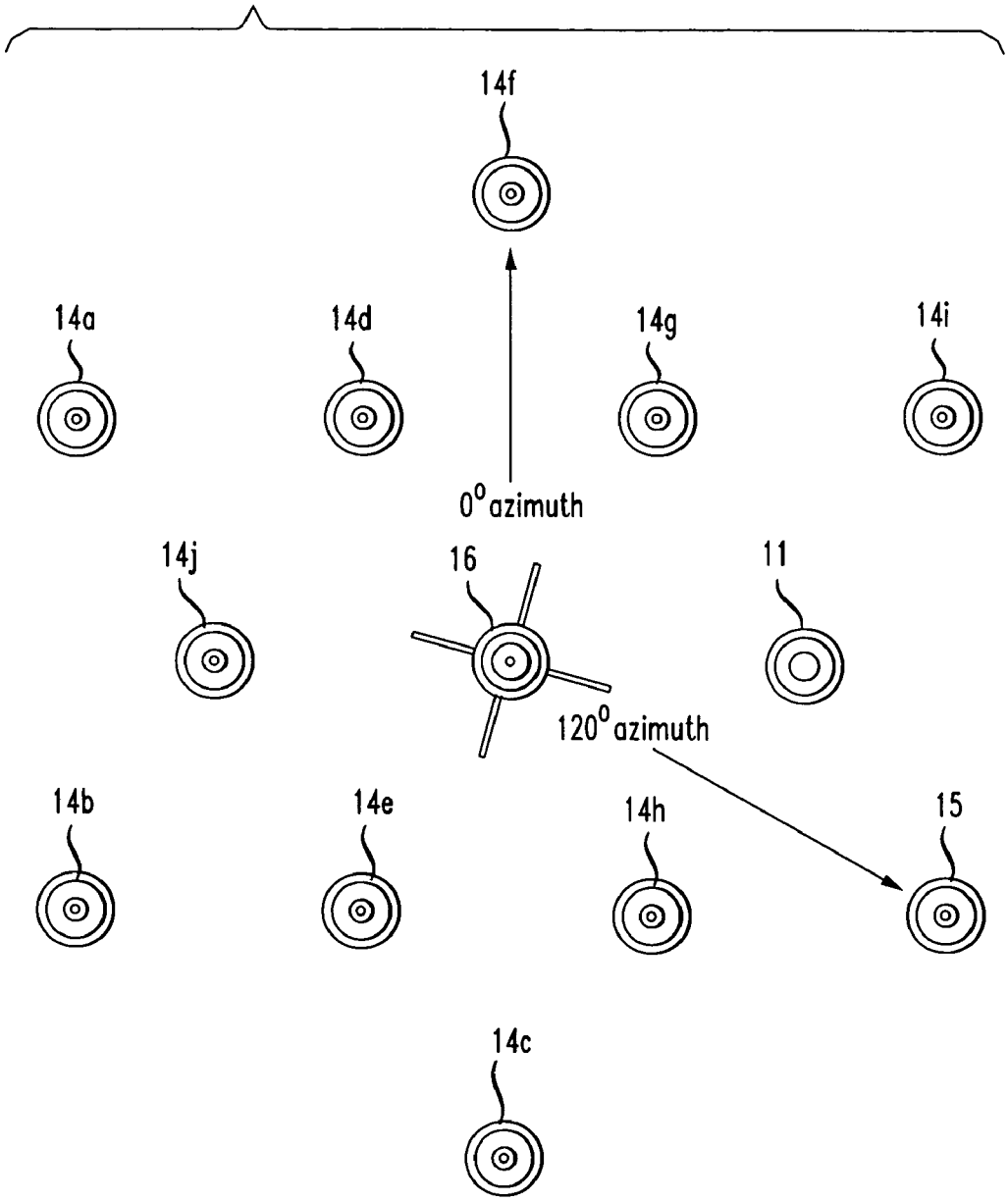
FIG. 3 is a head-on view of the dispersion pattern of the segments after the projectile has fully segmented.

This is seen in FIG. 2, depicting the five aft most segments after segmentation has occurred. The diversion of any given segment can be in any azimuthal direction radially away from the line of flight, resulting in any desired dispersion pattern, and depends on the pre-selected azimuth of notch N position on the projectile set during the final projectile assembly process. The magnitude of radial motion of each segment is selectable by the size (area) of its notch N. One such pattern is shown in FIG. 3. Tail segment 16 has continued on the original line of flight and the other segments have dispersed into the pattern shown. Segment 15, for example, has diverted in approximately the 120-degree azimuthal direction relative to the line of flight flown. Segments 14*a*, 14*b* and 14*c* have diverted in approximately the 300-, 240- and 180-degree azimuthal directions, respectively. In FIG. 2 certain of the segments are depicted larger or smaller than in FIG. 1 (albeit in an exaggerated fashion) to depict the fact that segment 14*a* has diverted out of the plane of the figure; that segments 15 and 14*b* have diverted into the plane of the figure; and that segment 14*c* has diverted even further into the plane of the figure. Although not shown in FIG. 2, the other segments of the projectile will also at this time be flying separately, each in its predetermined azimuthal direction, per FIG. 3. Illustratively, the azimuthal pattern is symmetric, but this is not required. Indeed, a wide variety of symmetric or non-symmetric dispersion patterns can be realized, as may be desired for a given application.

Figure 4:
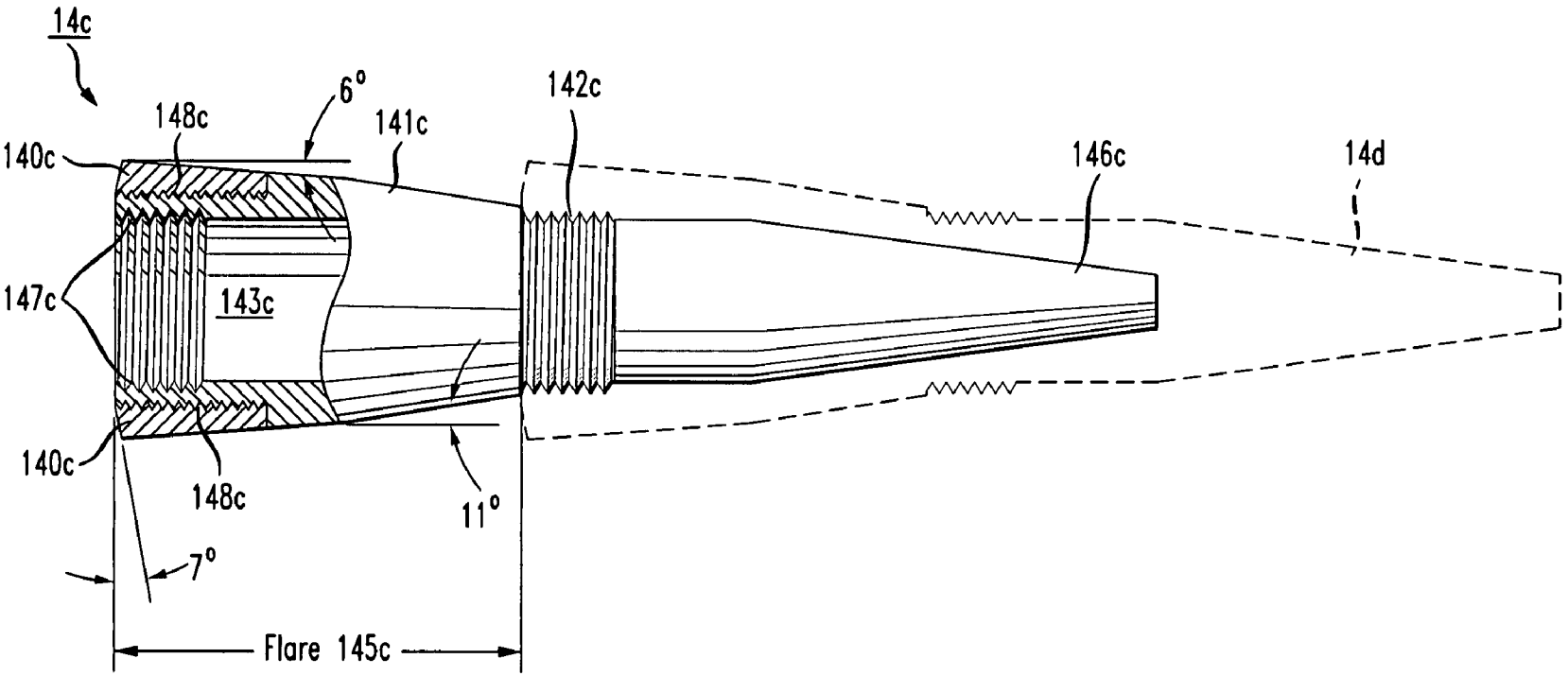
FIG. 4 is a partial cross-sectional view of a typical one of the intermediate segments of the projectile.

Segments 14*a*-14*j* are essentially identical to one another. FIG. 4 shows a partial cross-section of segment 14*c*, taken as illustrative.

Segment 14*c* is threaded onto segment 14*b* (not shown in FIG. 4) by way of interior threads 147*c* on the inner surface of the interior 143*c* of segment 14*c*. Threads 147*c* engage external threads on segment 14*b* that are similar to external threads 142*c* shown in the FIG. for segment 14*c*. Threads 142*c* engage interior threads of segment 14*d* (shown in phantom) that is ahead of segment 14*c* in the assembled projectile. The various threads just mentioned are illustratively shear threads that allow the segments to be pulled apart by whatever separation mechanism is used to provide the necessary segmentation force for the segments. Other techniques to initially hold the segments together but allow them to be pulled apart at segmentation time could be used.

The portion of each one of segments 14*a*-14*j* that is aft of its joint with the preceding segment is flared for stability. The flare angle is chosen so the segment static margin—the distance between mass center and lateral aero force center—is about between 3 to 5 percent of its length, as greater radial motion occurs as the segment becomes less stable. Thus, as shown in FIG. 4, segment 14*c* terminates in a flared portion, or flare, 145*c*. Flare 145*c* has two cone angles of about 11 and 6 degrees, respectively, as seen in FIG. 4. The steeper angle is inside the base flow of the preceding segment, so it will have a negligible drag contribution to the overall projectile.

The mechanism of the radial motion of the segments is explained as follows:

When an aerodynamic body such as the freely flying segment is at a small angle of attack, a radial (or lateral) force is produced normal to the body axis which is proportional to the angle of attack. If the axial position of this force is aft of the mass center, the flight will be "stable", in the sense that a slight increase in the angle of attack will be accompanied by a tendency to pitch the nose down, thereby reducing angle of attack. The degree of stability usually is controlled by selecting the angle of the flare, as increasing the flare angle moves the center of the radial force aft. This force is called "wind fixed", because its direction depends on the direction of the wind relative to the body axis.

The effect of the notch on the flare trailing edge is to introduce a second body fixed force mechanism. The base pressure on the freely flying body is close to ambient, usually slightly lower than ambient. Thus if the notch is deep enough, the pressure in the notch also will be close to ambient. Since the pressure on the side of the flare opposite the notch is high due to the flare angle, a differential force exists between the notch and its image on the opposite side, effectively causing a force increment outward from the notch and acting roughly at its centroid. The lever arm between the notch force and the body mass center is long compared to the lever arm of the radial force due to angle of attack. If the body is not spinning and the moments due to the two forces are in balance, then a "trim" condition will exist, and the body will fly at a "trim angle of attack". Because of the lever ratio, the angle of attack radial force will be much larger than the oppositely directed notch radial force. This unbalance of forces is the cause of the radial acceleration and motion. Reducing the stability margin will increase the lever ratio and thus the magnitude of the radially accelerating force.

Figure 5:
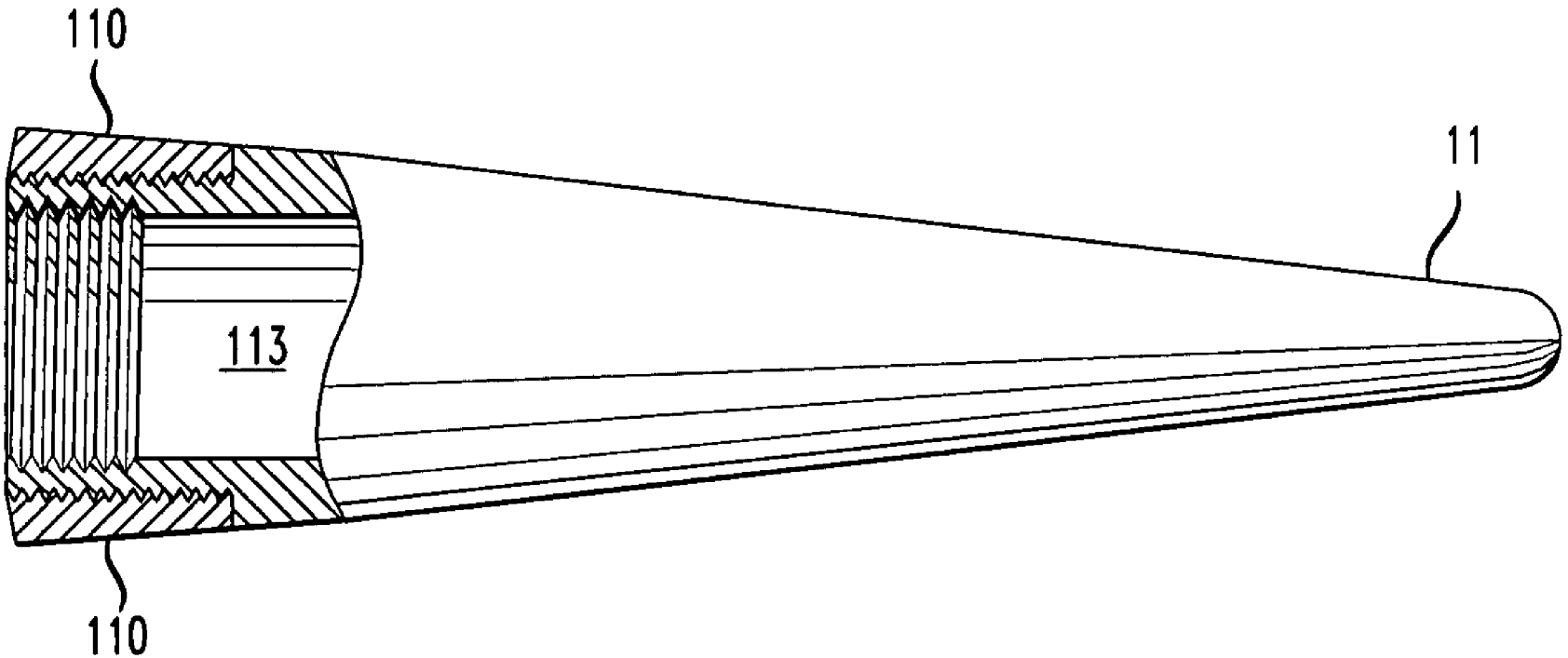
FIG. 5 is a partial cross-sectional view of the lead segment of the projectile.

Returning now to the drawing, lead segment 11 is shown in partial cross-section in FIG. 5. Although not depicted in the drawing, lead segment 11 threads onto segment 14*j* in a similar way to that described above relative to segments 14*a*-14*j*.

Figure 6:
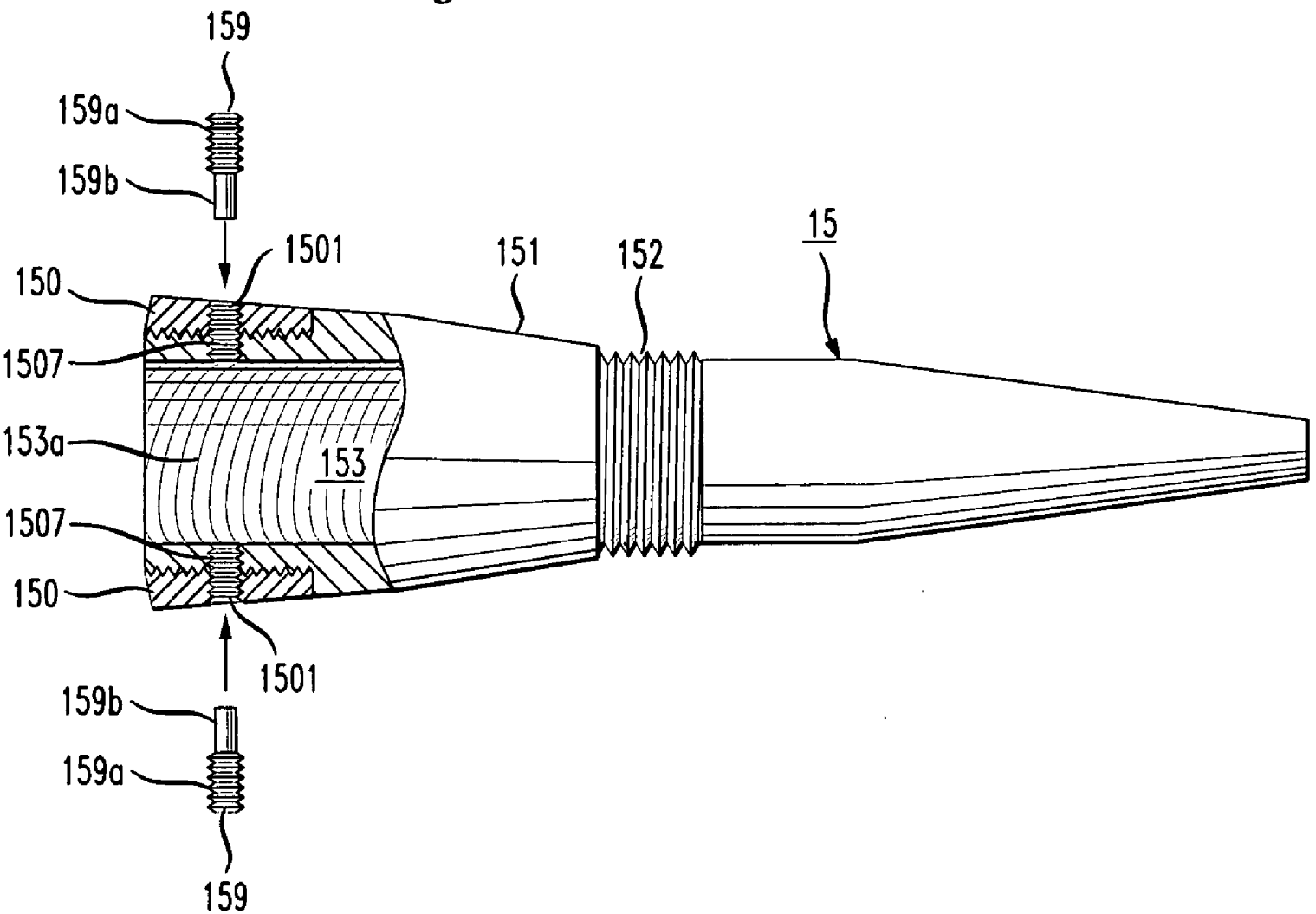
FIG. 6 is a partial cross-sectional view of the second-to-last segment of the projectile.

Second-to-last segment 15 is shown in partial cross-section in FIG. 6. Segment 15 has the same external configuration as segments 14*a*-14*j*.

Each of the segments 11, 14*a*-14*j* and 15 has a notched ring threaded into its aft portion, the notched ring having formed therein notch N shown in FIG. 1. For example, as shown in FIG. 4, a notched ring 140*c* is attached to the aft of segment 14*c*. Flare 145*c* is thus a notched flare. Segments 11 and 15 have similar notched rings, 110 and 150, respectively. In order to achieve a desired mass and balance for segments 14*a*-14*j* and 15, their respective notched rings are made from steel. In order to achieve a desired mass and balance for lead segment 11, its notched ring 110 is made from titanium alloy.

Figure 7:
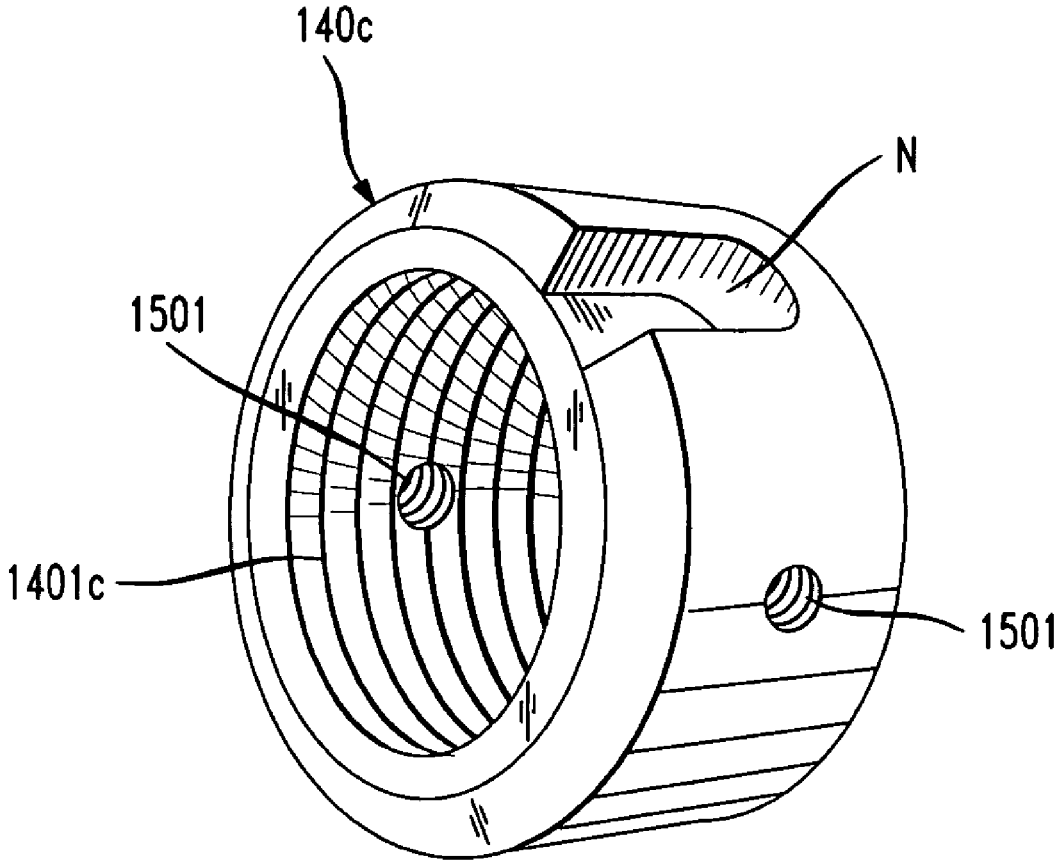
FIG. 7 is a perspective view of a notched ring that is fitted onto the various segments, the notch on a given segment causing it to divert from the projectile's original flight path.

A perspective view of notched ring 140*c*, which is illustrative of the notched rings on each of segments 11, 14*a*-14*j* and 15, is shown in FIG. 7. (Only the notched ring on segment 15, however, has threaded through-holes 1501, which are discussed below.) Notched ring 140*c* has inside threads 1401*c* that mate with threads 148*c* of segment 14*c*. Notched ring 140*c* has formed therein notch N, which causes segment 14*c* to be aerodynamically asymmetric. This causes segment 14*c* to divert from the projectile's original flight path once segment 14*c* has detached from the other segments. The azimuthal direction in which the notch on any given segment is pointing at the time it detaches from the remaining portion of the projectile determines the azimuthal the direction in which it will divert after the detaching has occurred. Thus when the overall projectile is being assembled, the notch in each of the notched rings of each of the segments 11, 14*a*-14*j* and 15 is oriented in a respective azimuthal direction relative to the notches on the other rings, causing the various segments to divert in respective directions. Once oriented, the notched ring can be fixed in place in any desired way, such as with a lock nut (not shown) that is then held fast with epoxy. In addition, various ones of the notches are of different sizes. The larger the surface across a notch, the greater will be the radial component of its velocity, i.e., the component of its velocity in the direction away from the original flight path of the projectile. Thus the combination of notch orientation and notch size determines the corresponding segment's position in the dispersion pattern, such as the dispersion pattern of FIG. 3. The design and orientation of the notches in order to achieve a desired dispersion pattern can be arrived at, for example, through straightforward application of aerodynamic principles. Since the segments continue to move away from the original line of flight until impact, the overall diameter the dispersion pattern is not only a function of the velocity of the segments but also the time that the segments fly between segmentation and target impact.

In order for notch N to have the effect just described, the overall projectile should be spinning as little as possible when segmentation begins. Otherwise, the segments will be spinning after detachment, and that spin will tend to overwhelm the aerodynamic effect of the notch and keep each segment on the original flight path of the projectile. A despinning of the projectile is carried out pursuant to the principles of the present invention, as discussed in further detail hereinbelow.

Figure 8:
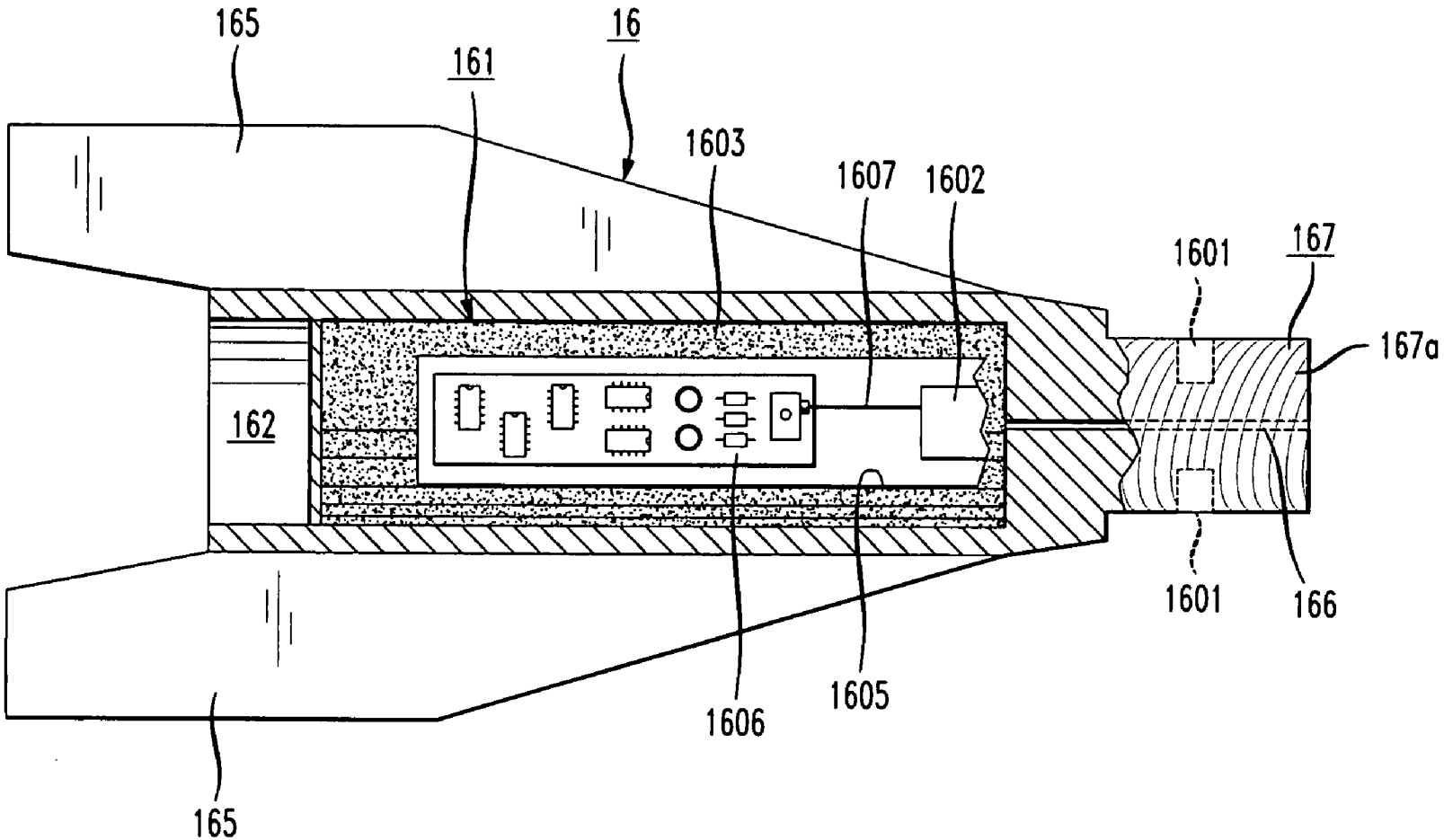
FIG. 8 is a cross-sectional view of the tail segment of the projectile.
Figure 9:
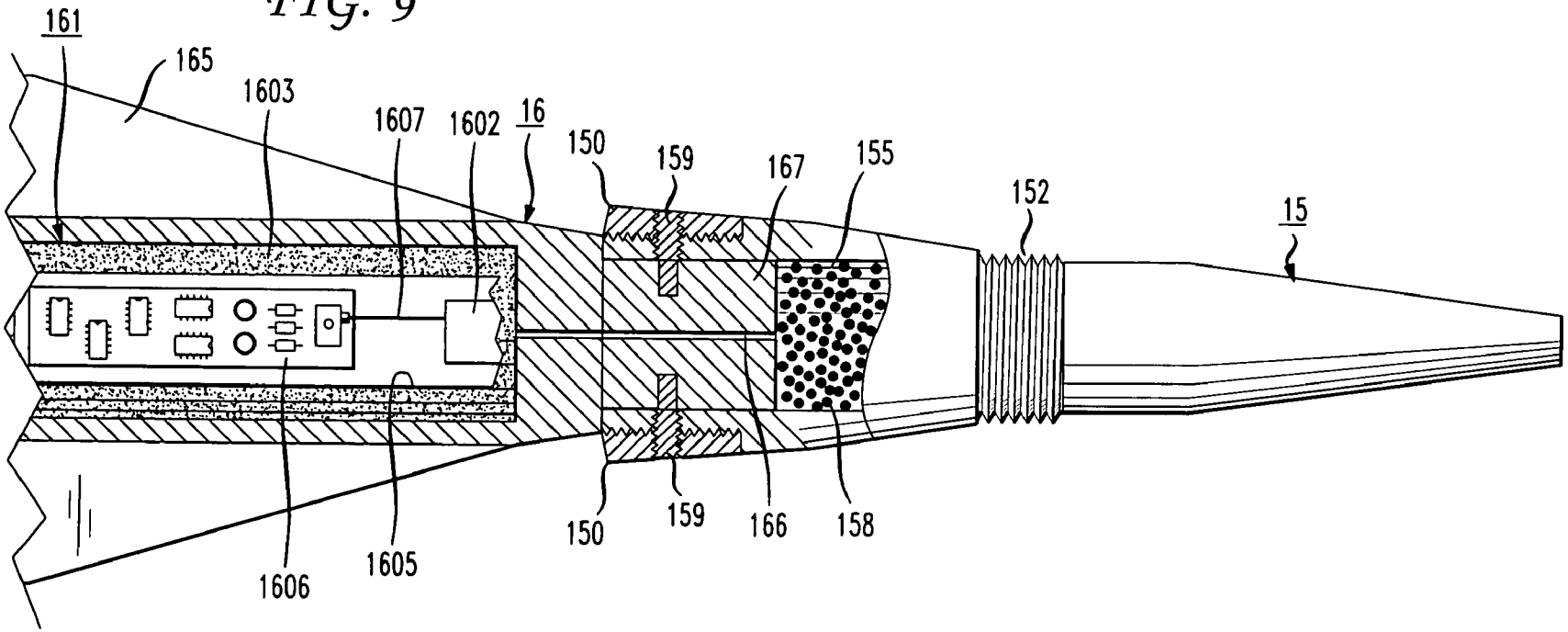
FIG. 9 is a cross-sectional view of the segments of FIGS. 6 and 8 mated as they would be within the overall projectile.

The last, or tail, segment 16 is shown in cross-section in FIG. 8 and is also shown in cross-section in FIG. 9 mated with segment 15. Tail segment 16 is illustratively made from a single piece of titanium alloy, so that its fins 165 are integral with the main body of the segment. Fins 165 may extend past the main segment body in order to assure stability of the overall projectile in a case where the fin span is relatively small, as may be needed to clear the rails of the projectile launcher.

Segment 16 includes fuze cavity 161 which contains a canister 1605 embedded in epoxy 1603. Contained within the canister are electronics 1606, which are also embedded in epoxy (not shown) within the canister in order to stabilize the electronics during flight. Electronics 1606 controls the setting off of an igniter 1602 via a signal on lead 1607 generated at an optimally selectable distance based on target type. A gas passage 166 extends through the nose, or rifled piston, 167 of tail segment 16, providing a path for the hot gases formed from the igniter into segment 15. Those hot gases ignite propellant 158—illustratively gun power—in mating chamber 153 of segment 15. The pressure of the propellant gases within mating chamber 153 of segment 15 pushes against piston 167 and causes tail segment 16 to detach from the remaining portion of the projectile. A separate tracer cavity 162 contains tracer material that emits a visible trail when the projectile is in flight, allowing personnel responsible for the launching of the projectile to follow its flight path visually.

It was noted earlier that it is desirable that projectile 10 should be spinning as little as possible when segmentation begins. On the other hand, it is desirable for a significant amount of spin to be imparted to the projectile at launch. This will minimize any effects of body fixed asymmetries throughout the projectile's flight prior to segmentation and thereby help keep the projectile on course until segmentation occurs. Indeed, fins 165 on tail segment 16 are canted about ½ degree relative to the projectile axis, so the projectile will spin up to an asymptotic rate on the order of tens of Hz after launch.

Accordingly, the spin is arrested prior to segmentation. The segments then come apart axially in a non-spinning or close-to-non-spinning condition.

Arresting of the spin is achieved by the design of second-to-last segment 15 and tail segment 16, pursuant to the principles of the present invention. In particular, FIG. 9 shows segments 15 and 16 in their mated configuration. As seen from FIGS. 6 and 8, the outer surface 167*a* of piston 167 and the surface 153*a* of chamber 153 that mates with piston 167 are rifled. Segments 15 and 16 are held together with shear pins 159 having a threaded section 159*a* which threads through threaded through-hole 1501 in the notched ring and into threaded through-hole 1507 in the body 151 of segment 15. A non-threaded portion 159*b* of each shear pin extends into a non-threaded hole 1601 in piston 167. For drawing simplicity, the FIGS. depict the use of two shear pins. In practice, however, three or four shear pins may be more desirable. This arrangement fixes the azimuth of notch N in notched ring 150, that azimuth thus serving as an azimuthal reference for all of the other notches in the projectile.

As previously noted, ignition of the igniter in cavity 161 propagates hot gases into mating chamber 153 of second-to-last segment 15. The pressure build-up in chamber 153 caused by gases formed when propellant 158 is ignited causes pins 159 to shear, thereby separating tail segment 16 from segment 15 and thus forcing tail segment 16 from the rest of the projectile, referred to herein as the "forward projectile." The aforementioned rifling causes the spin rate of tail segment 16 to increase during the period of time during which it is detaching from segment 15. The other inter-segment joints of the projectile are sufficiently tight that the increase in the spin rate of tail segment 16 causes a decrease in the spin rate of the forward projectile, per the law of the conservation of angular momentum. The rifling angle is illustratively 3 degrees—the angle being shown greatly exaggerated in the drawing—which, in this design, will reduce the spin rate of the forward projectile to approximately zero upon the detachment of tail segment 16. The spin rate of the forward projectile need not be reduced exactly to zero. Even if a small amount of residual spin—on the order of a few Hz that is something less than 10 Hz—remains, the aerodynamic effect of the notched ring notches will control the flight of the segments, thereby effectuating the desired diversion of the segments. Residual spin will cause rotation of the whole segment pattern, but it will not affect the relative positions of the segments in the pattern.

The projectile is designed in such a way that separation of segments 15, 14*a*, 14*b*, etc. from one another occurs sufficiently after the ignition of the propellant in fuze cavity 161 so as to allow tail segment 16 to separate completely from the rest of the projectile. This is desirable to ensure that the effect of the increased spin of tail segment 16 is fully imparted to the remaining projectile.

At the time of launch, before firing the projectile, the desired size of the pattern on the target—including the option of not deploying the segments, resulting in the impact of the overall projectile itself—is selected by the gunner or the launch platform's fire control system by preselecting the distance from the target that segmentation is to occur. As is conventional, the sabot discards away from the projectile after launch. As is called out in FIG. 4 by way of example, the trailing edge of each notched ring is beveled 7 degrees to allow the sabot to separate without significant disturbance. Thereafter, the propellant in fuze cavity 161 is ignited at a predetermined distance from the target, to reduce the overall projectile spin, followed by segmentation. The individual segments then continue on to the target in their desired dispersion pattern.

The foregoing merely illustrates the principles of the invention and numerous variations and alterations are possible. In particular, although the invention is disclosed herein in the context of the segmented rod projectile disclosed in the above-cited co-pending patent application, the invention can be implemented for any kind of projectile. Although in the illustrative embodiment the invention is used to reduce the spin of the remaining projectile, it could be used to increase the spin of the projectile if that were desired by imparting to the detached portion a spin relative to the remaining projectile that is in the opposite angular direction to the spin of the projectile itself. Moreover it may be possible to use mechanisms other than rifling to impart a relative spin to the portion of the projectile being detached. And it may be possible to use mechanisms other than gas pressure to detach the tail segment (or other portion) from the projectile, including mechanical means of various kinds.

The invention is disclosed herein in the context of a segmented rod projectile in which the segments disperse after segmentation. However the invention could also be used in a segmented rod projectile in which the segments are intended to fly collinearly to the target. In such a case, the principles of the invention could be used to impart a spin to each segment as it is detached from the rest of the projectile, thereby stabilizing its trajectory and helping to keep the segments flying collinearly all the way to the target. In such a use of the invention, it may be desirable for the angular direction of spin imparted to each segment to be the opposite of that imparted to the segment fore and aft of it, such as clockwise for the odd-numbered segments and counter-clockwise for the even-number segments. This is advantageous because in such a projectile any number, or perhaps all, of the segments may be in the process of detaching from one another at the same time. That is, even before a segment has fully detached from the segment ahead of it, the latter may have already started detaching from the segment that is yet ahead of it, and so forth. As a result, if the segments are all imparted with the same direction of spin, the spinning up of one segment will tend to be counteracted by the spinning up of the segments fore and aft of it. This effect can be compensated for by appropriate segment design. However, the overall segmentation of the projectile will usually take longer in that case than if the segments were spun up in alternate angular directions, because then the up-spinning of one segment in its assigned angular direction tends to reinforce the up-spinning in the opposite direction of its neighbor segments.

It will thus be appreciated that although a specific embodiment of the invention is shown and described herein, those skilled in the art will be able to devise numerous arrangements which, although not shown or described herein, embody the principles of the invention and are thus within their spirit and scope.

The invention claimed is:

1. A projectile having a plurality of segments adapted to be detached from the rest of the projectile during flight, the projectile being designed in such a way that a spin is imparted to at least a first one of the segments relative to the rest of the projectile during a period of time in which the first segment is being detached from the projectile, wherein the first segment is interconnected with the rest of the projectile at a rifled interface that causes the spin to be imparted to the first segment when it is being detached from the rest of the projectile, wherein the first segment is a tail segment that includes a piston having an outer surface that mates with the inner surface of a mating chamber in the aft end of the rest of the projectile, at least one of the surfaces being rifled so that the spin is imparted to the tail segment when it is being detached from the rest of the projectile, wherein the mating chamber includes a propellant that, when ignited, creates gases that push on the piston and forces the tail segment from the rest of the projectile, and wherein the tail segment includes a gas passage extending through the piston and an igniter which, when ignited, causes hot gases to propagate through the gas passage into the mating chamber to ignite the propellant in the mating chamber.

2. The projectile of claim 1 wherein the rate of spin of the rest of the projectile is changed due to the law of the conservation of angular momentum.

3. The projectile of claim 1 wherein, as a result of the spin being imparted to the segment, its angular momentum is changed by a particular amount, and wherein the angular momentum of the rest of the projectile is changed by an amount that is substantially equal in magnitude but opposite in sign to the change in angular momentum of the segment.

4. The projectile of claim 1 wherein the projectile further includes one or more connectors interconnecting the tail segment with the rest of the projectile and wherein the gases push against the piston with enough force to break the connectors.

5. The projectile of claim 4 wherein the one or more connectors are shear threads or shear pins.

6. The projectile of claim 1 wherein the amount of spin imparted to the first segment relative to the remaining projectile is such as to reduce the remaining projectile's rate of spin to substantially zero.

7. A projectile comprising a forward projectile comprising a plurality of segments each of which is adapted to be detached from the rest of the forward projectile during flight, an aft one the segments including a mating chamber at its aft end, a tail segment having a piston mated with the mating chamber, and means for causing the tail segment to detach from the forward projectile during flight of the projectile, the piston having an outer surface that is in contact with an inner surface of the mating chamber over a period of time during which the tail segment is detaching from the forward projectile, at least one of the surfaces being rifled in such a way that a spin is imparted to the tail segment relative to the forward projectile during said detaching, wherein the mating chamber includes a propellant that, when ignited, creates gases that push on the piston and forces the tail segment from the forward projectile, wherein the projectile further includes one or more connectors interconnecting the tail segment with the forward projectile and wherein the gases push against the piston with enough force to break the connectors, and wherein the tail segment includes a gas passage extending through the piston and an igniter which, when ignited, causes hot gases to propagate through the gas passage into the mating chamber to ignite the propellant in the mating chamber whereby a rate of spin of the forward projectile is changed.

8. The projectile of claim 7 wherein the rate of spin of the forward projectile is changed due to the law of the conservation of angular momentum.

9. The projectile of claim 7 wherein, as a result of the spin being imparted to the tail segment, its angular momentum is changed by a particular amount and the angular momentum of the forward projectile is changed by an amount that is substantially equal in magnitude but opposite in sign to that of the change in the angular momentum of the tail segment.

10. The projectile of claim 8 wherein the amount of spin imparted to the tail segment relative to the forward projectile is such as to reduce the forward projectile's rate of spin to substantially zero.

* * * * *